United States Patent [19]

Lubin

[11] 4,316,296

[45] Feb. 23, 1982

[54] WASH BASIN ATTACHED SHELF

[76] Inventor: Vincent M. Lubin, 1064 Brooklawn Ct., Troy, Mich. 48084

[21] Appl. No.: 69,226

[22] Filed: Aug. 23, 1979

[51] Int. Cl.[3] ..... E03C 1/00; A47L 19/02; F16B 2/20

[52] U.S. Cl. ..... 4/630; 4/656; 211/88; 248/205 R; 248/226.5; D6/86; D6/132

[58] Field of Search ..... 4/517, 551, 630, 571–579, 4/589, 590, 621, 629, 637, 619, 654, 656, 659, 628, 638, 643, 622; 211/88, 90, 134, 105.1; 248/205 R, 214, 226.5; D6/86, 132; 108/44, 152; 182/156

[56] References Cited

U.S. PATENT DOCUMENTS

| | | | |
|---|---|---|---|
| 1,327,039 | 1/1920 | Harris | 4/656 |
| 1,439,351 | 12/1922 | Alsip et al. | 248/226.5 X |
| 1,850,599 | 3/1932 | Milner | 108/46 X |
| 1,985,658 | 12/1934 | Heise et al. | 4/654 X |
| 2,045,965 | 6/1936 | Rosen | 4/654 |
| 2,141,347 | 12/1938 | Davis | 211/105.1 |
| 2,144,183 | 1/1939 | Glove | 4/656 |
| 2,245,277 | 6/1941 | Ivy | 248/214 X |
| 2,518,538 | 8/1950 | Giblin | 248/226.5 X |
| 2,590,793 | 3/1952 | Rigstad | 4/656 X |
| 2,659,491 | 11/1953 | Williams | 248/214 X |
| 2,678,083 | 5/1954 | Dall et al. | 4/578 |
| 2,746,664 | 5/1956 | Stimic | 182/156 X |
| 3,039,616 | 6/1962 | Proffit | 108/46 X |
| 3,101,486 | 8/1963 | Tiller | 4/654 X |
| 3,202,116 | 8/1965 | Wilson | 108/46 |
| 3,591,871 | 7/1971 | Segal | 4/656 |
| 3,706,105 | 12/1972 | Nicholas | 211/88 X |
| 3,895,605 | 7/1975 | Goldman | 211/88 X |
| 4,052,816 | 10/1977 | Perez | 211/88 X |

*Primary Examiner*—Stuart S. Levy

*Attorney, Agent, or Firm*—Basile, Weintraub and Hanlon

[57] ABSTRACT

A shelf attachable to wash basins is disclosed. The shelf comprises a planar horizontal surface overlaying a rim of the basin with a bowl engaging wall integral with an inner edge of the horizontal surface which abuts the surface of the bowl. A downward and inward extending wall integral with an outer edge of the horizontal surface engages an apron of the bowl. A clip is employed to attach the downward and inward extending wall to the apron. The clip includes a first leg integral with a bottom edge of the downward and inward extending wall abutting the apron and a second leg spaced from the first leg to snugly engage the apron between the legs.

2 Claims, 5 Drawing Figures

WASH BASIN ATTACHED SHELF

BACKGROUND OF THE INVENTION

I. Field of the Invention

The present invention relates to the field of accessories for lavatory wash basins. More particularly the present invention relates to the field of accessories for lavatory wash stands which are attached thereto. Even more particularly the present invention relates to shelves releasably attachable to wash basins.

II. Description of the Prior Art

A search of the prior U.S. patents reveals the following U.S. patents which disclose devices related to the field of the present invention.

U.S. Pat. No. 2,141,347 discloses a bowl attached towel rack which is affixed to the downward extending apron at the side of a wash basin.

U.S. Pat. No. 2,746,664 discloses a portable support which supports a platform between a wash basin and the floor. An upper end of the support is affixed to a downward extending apron of the bowl.

U.S. Pat. No. 3,591,871 discloses a soap dish affixed to a portable lavatory bowl. The soap dish is affixed in a removable manner by engaging an aperture disposed in a horizontal flange of the bowl near the edges thereof.

None of the above listed U.S. patents disclose a shelf attachable to a wash basin in a removable manner. The above listed U.S. patents constitute the closest art known to the Applicant and his Attorney.

SUMMARY OF THE INVENTION

The present invention comprises a shelf attachable to wash basins of the type which include a vertical apron along the perimeter thereof. The shelf comprises a planar horizontal surface which overlies a rim of the basin and extends transversely to an edge of the bowl and transversely outward a distance from the apron to form a shelf. A downward an inward extending wall integral with an outer edge of the horizontal surface extends to a lower portion of the apron.

A clip is employed to attach a lower end of the downward and inward extending wall to the apron. The clip comprises a first leg integral with a bottom edge of the downward and inward extending wall which abuts the apron, a second leg spaced from the first leg to snugly engage the apron between the legs. A bottom wall of the clip is integral with a lower portion of the legs to join the legs in a spaced apart manner. A bowl engaging wall extends downward from an inner edge of the horizontal surface to abut the bowl and position the shelf at an edge of the basin.

Other means may alternately be employed for attaching the lower end of the downward and inward extending wall including suction cups and clamps.

For a more complete understanding of the present invention reference is made to the following detailed description and accompanying drawing.

Other objects, advantages, and applications of the present invention will become apparent to those skilled in the field to which this invention pertains, when the accompanying description of the best modes contemplated for practicing the invention are read in conjunction with the accompanying drawing.

BRIEF DESCRIPTION OF THE DRAWING

In the drawing like reference numbers refer to like parts throughout the several views, and wherein.

DESCRIPTION OF THE PREFERRED EMBODIMENTS

In small bathrooms and washrooms because of space limitations only a small wash basin is often provided with little or no shelving or counter space to support razors and other toilet articles. In addition, the rim of wash basins seldom provide enough flat area for safely supporting toilet articles. The smooth rounded surfaces of the wash basins allow articles supported thereon to slide off of the surface and often be broken.

It is an object of this invention to provide a shelf which is attachable to wash basins which provides a horizontal surface on which toilet articles may be safely supported.

It is a further object of the present invention to provide a shelf attachable to wash basins in a releasable manner.

It is also an object of the present invention to provide a shelf attachable to wash basins in a detachable manner employing an apron of the wash basin to support the shelf to the bowl.

Figure 1:
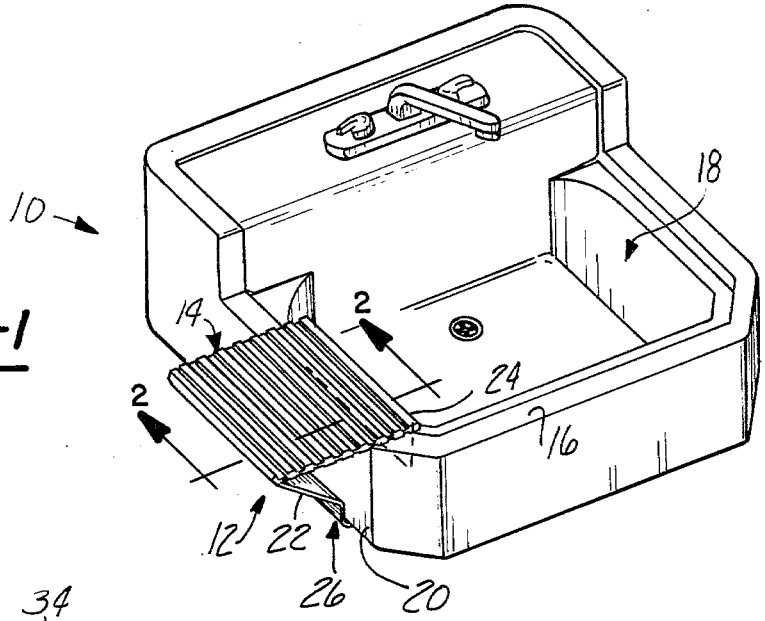
FIG. 1 illustrates a preferred embodiment of the present invention mounted to a wash basin.
Figure 2:
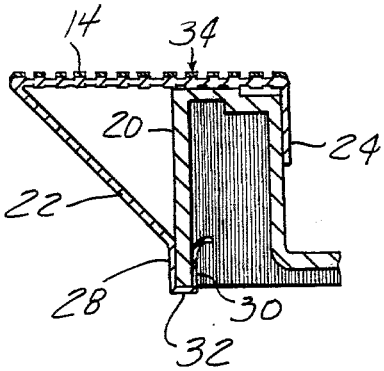
FIG. 2 illustrates a cross sectional view of the shelf of FIG. 1 taken along the lines 2—2 of FIG. 1.

Referring now to the drawing and particularly to FIGS. 1 and 2 wherein there is illustrated at 10 a preferred embodiment of the present invention. The present invention comprises a shelf 12 including a planar horizontal surface 14 resting on a rim 16 of a wash basin 18. The wash basin 18 includes a vertical apron 20 extending around the perimeter thereof. A downward and inward extending wall 22 is integral with an outer edge of the horizontal surface 14 and extends downward and inward to meet the apron 20. A means 26 is provided for attaching a lower end of the downward and inward extending wall 22 to the apron 20. A bowl engaging wall 24 integral with an inner edge of the horizontal surface 14 extends downward abutting the bowl to attach the shelf 12 to the wash basin 18.

The means 26 comprises a clip including a first leg 28 integral with a bottom edge of the downward and inward extending wall 22 and a second leg 30 spaced from the first leg to snugly engage the apron between legs 28 and 30. A bottom wall 32 of the clip extends between the legs 28,30 to join them and form an integral member.

A plurality of longitudinal ridges 34 extend along the horizontal surface 14. The surface of the shelf 12 is covered with a resilient material such as rubber or plastic to provide a surface against which toilet articles may rest without sliding.

Figure 3:
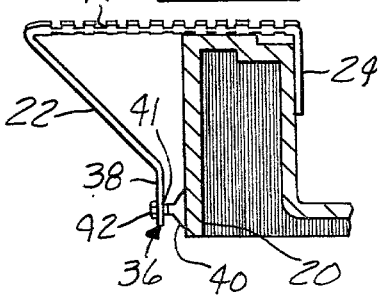
FIG. 3 illustrates an alternate embodiment of the present invention employing suction cups to affix the shelf to the apron of the wash bowl.

Referring now to the drawing, and in particular to FIG. 3, wherein there is illustrated at 36 another embodiment of the means for attaching a lower end of the downward and inward extending wall to the apron. The means 36 comprises one or more downward extending tabs 38 integral with a bottom edge of the downward and inward extending wall 22 and an aperture (not shown) formed at a lower end of the tabs.

A suction cup 40 includes a threaded rod 41 extending from an end thereof which engages the aperture (not shown) and a nut 42 threadingly engages the threaded rod 41 to secure the suction cup to the tab. The suction cup 40 abuts the apron 20 to secure the tab and the downward and inward extending wall to the apron.

Figure 5:
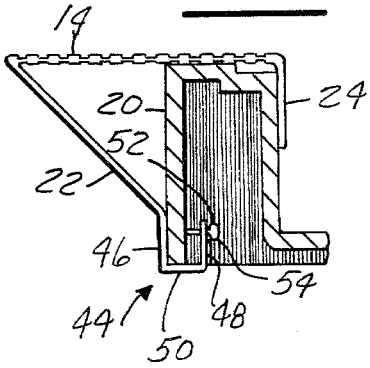
FIG. 5 illustrates an alternate means for clamping the shelf to the apron of the bowl.

Referring again to the drawing and in particular to FIG. 5 wherein there is illustrated another alternate embodiment of the means for attaching the downward and inward extending wall to the apron. A means 44 comprises a downward extending leg 46 integral with a lower end of the downward and inward extending wall 22 and an inside leg 48 spaced from the downward extending leg, with a lower wall 50 joining a lower end of the legs 46,48 to form an integral structure. A threaded aperture 52 is formed at an upper end of the inside leg 48 and a thumb screw 54 including a threaded end threadingly engages the threaded aperture 52 and tightening of the thumb screw 54 secures the leg 46 to the apron 20. In an alternate embodiment, the downward extending leg 46 employs an adhesive backed tape interposed the leg and the apron to affix the downward and inward extending wall. This illuminates the need for the inside leg and the thumb screw.

Figure 4:
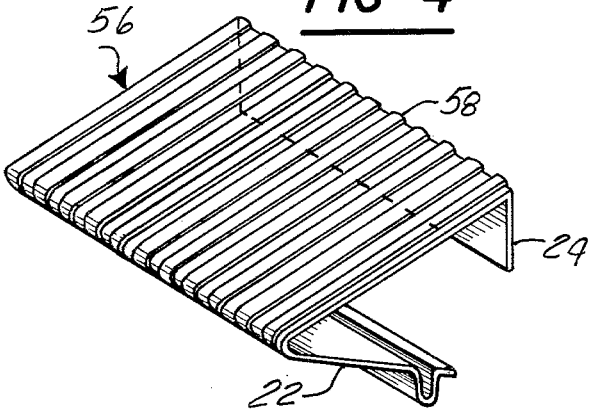
FIG. 4 illustrates another embodiment of the present invention employing a shelf with transverse ridges sloping toward the bowl for drainage.

FIG. 4 of the drawing illustrates another embodiment of a planar surface 56 for the shelf. The surface 56 is inclined toward the bowl and contains a plurality of transverse ridges 58 to drain water from the shelf into the bowl. There has been described hereinabove a shelf releasably attachable to a wash basin. The shelf comprises a planar horizontal surface overlaying a rim of the basin, the shelf being retained to the basin by a bowl engaging wall and a downward and inward extending wall affixed to the vertical apron of the wash basin. The shelf is easily removed from the wash basin to allow cleaning.

Having thus described my invention, what I claim is:

1. A shelf attachable to wash basins which include a vertical apron at the perimeter thereof comprising:

the shelf made from a single continuous piece of material and including;

a planar horizontal wall overlaying a rim of the basin including a ridged upper surface and a ridged lower surface said upper surface covered with a soft resilient material to prevent slipping of articles placed thereon and to stiffen the horizontal wall;

the ridges disposed transversely and inclined toward the bowl; to drain the shelf into the bowl a generally planar downward and inward extending wall integral with and extending from an outer edge of the horizontal surface abutting the apron at a lower end thereof to provide support for the upper surface means for attaching a lower end of the downward and inward extending wall to the apron comprising a clip including a first leg formed by a downward extending wall bent inward along a lower edge of the apron, with an upward extending second leg formed by bending the clip upward to abut an inner surface of the apron, an upper edge of the clip bent inward a distance to aid in engaging the apron lower edge, the clip snugly engaging the apron between legs;

a bowl engaging wall integral with an inner edge of the horizontal surface extending downward abutting the bowl;

said bowl engaging wall squeezing the bowl at the inner edge and at the apron and positioning the shelf at an edge of the bowl;

the shelf walls integrally formed of a single continuous planar piece with all portions having an elongated horizontal planar dimension; and whereby the shelf is retained to the basin by the bowl engaging wall abutting the bowl and the downward and inward extending wall affixed to the apron with the shelf attachable to the bowl and removable from the bowl for cleaning without alteration of the bowl.

2. The shelf as defined in claim 1 wherein the horizontal surface contains a plurality of longitudinal ridges.

* * * * *